US007306073B2

(12) United States Patent
Frasl

(10) Patent No.: US 7,306,073 B2
(45) Date of Patent: Dec. 11, 2007

(54) ELECTROACOUSTIC TRANSDUCER COMPRISING A MEMBRANE WITH A MIDDLE AREA COMPRISING STIFFENING GROOVES

(75) Inventor: Ewald Frasl, Biedermannsdorf (AT)

(73) Assignee: NXP B.V., Eindhoven (NL)

( * ) Notice: Subject to any disclaimer, the term of this patent is extended or adjusted under 35 U.S.C. 154(b) by 100 days.

(21) Appl. No.: 10/535,297

(22) PCT Filed: Oct. 31, 2003

(86) PCT No.: PCT/IB03/04924

§ 371 (c)(1),
(2), (4) Date: May 17, 2005

(87) PCT Pub. No.: WO2004/047487

PCT Pub. Date: Jun. 3, 2004

(65) Prior Publication Data

US 2006/0070796 A1 Apr. 6, 2006

(30) Foreign Application Priority Data

Nov. 21, 2002 (EP) ..... 02102615

(51) Int. Cl.
*H04R 7/14* (2006.01)

(52) U.S. Cl. ..... 181/173; 181/157; 181/161; 181/164; 181/166; 181/167; 381/398; 381/162; 381/423; 381/430; 381/424; 381/432; 381/431; 381/392

(58) Field of Classification Search ..... 181/173, 181/157, 161, 164, 166, 167, 165, 174; 381/398, 381/162, 423, 430, 424, 432, 431, 392
See application file for complete search history.

(56) References Cited

U.S. PATENT DOCUMENTS

| | | | | | |
|---|---|---|---|---|---|
| 1,040,294 | A | * | 10/1912 | Hoffman | 181/167 |
| 1,870,417 | A | * | 8/1932 | Mallina | 181/170 |
| 2,351,904 | A | * | 6/1944 | Ora et al. | 381/398 |
| 4,665,316 | A | * | 5/1987 | Hodges | 250/551 |
| 6,594,372 | B2 | * | 7/2003 | Nakaso | 381/396 |
| 6,920,957 | B2 | * | 7/2005 | Usuki et al. | 181/173 |
| 2001/0010725 | A1 | * | 8/2001 | Frasl | 381/150 |

FOREIGN PATENT DOCUMENTS

| | | | |
|---|---|---|---|
| JP | 5592095 | * | 7/1980 |
| JP | 02057097 | * | 2/1990 |
| WO | WO0156330 A2 | | 8/2001 |
| WO | WO0160530 A1 | | 8/2001 |

* cited by examiner

*Primary Examiner*—Lincoln Donovan
*Assistant Examiner*—Forrest Philips
(74) *Attorney, Agent, or Firm*—Peter Zawilski

(57) ABSTRACT

A membrane (20) has a membrane axis (5) and a middle area (50), a central cup-shaped depression (52) being provided around said membrane axis (5), which depression (52) preferably has a connecting channel (53), wherein the middle area (50) comprises groups of stiffening grooves (54, 55, 56, 57) which extend parallel to radial directions and of which a first group of long stiffening grooves (54, 55, 56) extends up to the depression (52), said connecting channel (53) issuing into two of the long stiffening grooves (55, 56), thus interconnecting these two long stiffening grooves (55, 56).

11 Claims, 2 Drawing Sheets

ELECTROACOUSTIC TRANSDUCER COMPRISING A MEMBRANE WITH A MIDDLE AREA COMPRISING STIFFENING GROOVES

The invention relates to a membrane for an electroacoustic transducer, which membrane is designed to be capable of vibration with respect to a membrane axis, which has a first membrane side and a second membrane side, and which has a middle area.

The invention further relates to an electroacoustic transducer with a membrane.

An electroacoustic transducer of the kind mentioned in the first paragraph and a membrane of the kind mentioned in the second paragraph above are known, for example, from the patent document WO 01/60530 A1. The known electroacoustic transducer is designed for generating and providing sound in a certain frequency range by means of the known membrane in conjunction with a coil connected to the membrane and by means of a magnet system acting on the coil. The known membrane has a membrane axis and a substantially dome-shaped middle area around the membrane axis. The shape of the membrane in the middle area is the determining factor for the generation and projection of medium to high frequencies within the audible range.

The known electroacoustic transducer comprising such a known membrane is used for known purposes in comparatively small appliances, for example as loudspeakers in mobile telephones. It is now a major concern to construct such an electroacoustic transducer as small as possible so as to contribute to a miniaturization of such a mobile telephone. An essential constructional geometry of an electroacoustic transducer is given by the constructional height of the transducer, and is accordingly influenced by the shape of the membrane and in particular the shape of the middle area thereof. The known membrane has a comparatively great constructional height because of its dome-shaped middle area, which is very disadvantageous in view of the desired miniaturization of appliances as mentioned above, in which such an electroacoustic transducer with such a membrane will be used.

The invention has for its object to eliminate the drawbacks mentioned above and to provide an improved membrane for a transducer and an improved electroacoustic transducer with a membrane.

To achieve the above object, inventive features are provided in a membrane according to the invention such that a membrane according to the invention can be characterized as follows:

A membrane for an electroacoustic transducer, which membrane is designed to be capable of vibration with respect to a membrane axis, and which has a first membrane side and a second membrane side, and which has a middle area, wherein a central cup-shaped depression is present in the region of the membrane axis, which depression is bounded by a cup bottom wall and which is open towards the first membrane side, and wherein the membrane has stiffening grooves in its middle area which stiffening grooves extend substantially parallel to radial directions, and wherein at least two of said stiffening grooves extend up to the depression.

To achieve the above object, furthermore, inventive features are provided in an electroacoustic transducer according to the invention such that an electroacoustic transducer according to the invention can be characterized as follows:

An electroacoustic transducer having a membrane, wherein the transducer is provided with a membrane according to the invention.

The provision of the inventive features achieves in a constructionally comparatively simple manner and with little additional expenditure in practice that a membrane with an advantageously low middle area can be realized in the case of a membrane according to the invention for an electroacoustic transducer according to the invention, it being even possible to construct the middle area fully planar. Such a membrane has very good acoustic properties in spite of its flatness, i.e. low constructional height, because the presence of the stiffening grooves positively influences the mechanical properties of the membrane according to the invention, i.e. in particular its rigidity. The use of an electroacoustic transducer according to the invention with a membrane according to the invention in appliances with thin housings is highly advantageous because of the flatness of the membrane according to the invention thus made possible and the resulting small constructional height of the membrane and accordingly of the electroacoustic transducer.

The stiffening grooves may be open alternately towards the first membrane side and towards the second membrane side in a membrane according to the invention. It was found to be particularly advantageous in a membrane according to the invention, however, if in addition the characterizing features of claim 2 are provided. This is advantageous for a simple manufacture of the membrane.

It was further found to be highly advantageous in a membrane according to the invention if in addition the characterizing features of claim 3 are provided. The depression with its connecting channel provides the advantage of good properties in the generation and emission of medium to high frequencies within the audible range.

The additional provision of the characterizing features of claim 4 in a membrane according to the invention achieves a regular and symmetrical structure, resulting in an evenly distributed stiffness or rigidity of the middle area.

All stiffening grooves may extend up to the depression in a membrane according to the invention. It was found to be particularly advantageous if in addition the features of claim 5 are provided in such a membrane, because in this case the depression can be of small dimensions in radial directions, which is particularly advantageous for achieving good properties in the generation and emission of sound.

The additional provision of the characteristics of claim 6 in a membrane according to the invention leads to the advantage that no undefined membrane portions are present, and that thus no undefined membrane movements can interfere with the projected sound during the emission of sound.

The stiffening grooves in a membrane according to the invention may have a slightly curved, sweeping, or undulating shape. It was found to be particularly advantageous if in addition the characterizing features of claim 7 are provided. This leads to a particularly good stiffening of the membrane in its middle area.

Furthermore, the stiffening grooves in a membrane according to the invention may have an arcuate cross-section and/or an arcuate longitudinal section. The groove side walls may also have an arcuate gradient. The arcuate cross-section and the arcuate longitudinal section and the arcuate gradient of the groove side walls may be convex or concave. It was found to be particularly advantageous, however, if in addition the characteristics of claim 8 are provided. This achieves a particularly high stability of the membrane.

The additional provision of the characterizing features of claim 9 in a membrane according to the invention leads to the advantage that an optimum construction is obtained both as regards a manufacturing process for making the membrane and as regards the stiffness of the membrane in its middle area.

The additional provision of the characterizing features of claim 10 in a membrane according to the invention leads to the advantage that the depression, which together with the connecting channel makes an essential contribution to the stiffening of the membrane in its middle area, has an optimized construction.

The advantages described above for a membrane according to the invention are equally valid for an electroacoustic transducer according to the invention.

The above and further aspects of the invention will become apparent from the embodiment described below and are clarified with reference to this embodiment.

The invention will now be explained in more detail with reference to an embodiment shown in the drawings, to which, however, the invention is not limited.

Figure 1:
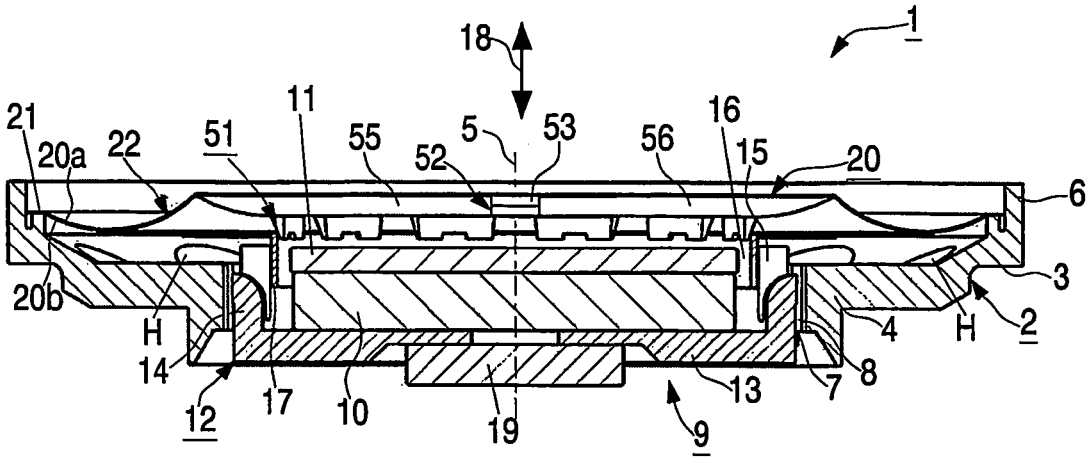
FIG. 1 is a cross-sectional view, partly diagrammatic, of an electroacoustic transducer in an embodiment of the invention, comprising a membrane according to an embodiment of the invention.

FIG. 1 shows an electroacoustic transducer 1, denoted the transducer 1 for short below, which is constructed as a loudspeaker. The transducer 1 has a housing 2 of synthetic resin, which housing 2 is often denoted the basket. The housing 2 has a first stage 3 and a second stage 4, which two corners 3 and 4 merge into one another. Holes H are provided in the region between the first stage 3 and the second stage 4 so as to connect the so-termed rear space volume to the acoustic free space. A hollow cylindrical housing portion 6 extending in the direction of a transducer axis 5 is connected to the first stage 3. A planar housing portion 7 is connected to the second stage 4, in which portion a circular cylindrical passage 8 is provided.

The transducer 1 comprises a magnet system 9. The magnet system 9 is formed by a magnet 10 and a pole plate 11 and a pot 12, which pot 12 is often denoted the outer cup and is formed by a planar pot bottom 13 and a hollow cylindrical pot wall 14. The entire magnet system 9 is fastened to the second stage 4 of the housing 2 by means of the pot wall 14 of the pot 12 in that an adhesive connection (not shown) is provided in the passage 8 between the pot wall 14 and the second stage 4. The pot 12 of the magnet system 9 projects with its pot bottom 13 through the passage 8 in the planar housing portion 7, while a mechanically and acoustically closed connection is formed by the adhesive connection between the planar housing portion 7 and the pot 12. It should be noted that the acoustically closed connection may equally well be realized by means of a press fit.

An air gap 16 is formed between the circumferential limiting surface of the pole plate 11 and the end region 15 of the hollow cylindrical cup wall 14 facing the pole plate 11. A vibration coil 17 of the transducer 1 is partly accommodated in the air gap 16. The vibration coil 17 can be set into vibration by means of the magnet system 9 substantially parallel to a vibration direction indicated in FIG. 1 by a double arrow 18 and parallel to the transducer axis 5. The vibration coil 17 is connected to a membrane 20 of the transducer 1, the construction of which will be described in detail below with reference to FIGS. 2 to 4. The membrane 20 can be made to vibrate by the vibration coil 17 substantially parallel to the vibration direction 18 and accordingly parallel to the transducer axis 5. It should be noted that the transducer axis 5 is at the same time a membrane axis 5 of the membrane 20.

The membrane 20 will now be described in detail with reference to FIGS. 2 to 4, from which FIGS. 2 to 4 the construction of the membrane 20 can be gathered.

The membrane 20 comprises a first membrane side 20*a* formed by its front face and a second membrane side 20*b* formed by its rear face. The membrane 20, which is made of a polycarbonate foil in the present case, has a middle area 50 and the membrane axis 5 mentioned above. The membrane 20 further has an annular outer region 21, by means of which outer region 21 the membrane 20 is fastened to the housing 2 of the transducer 1 of FIG. 1. Between the middle area 50 and the outer region 21 there is an annular pleated region 22 which is of circular annular shape in this case and immediately adjoins the outer region 21.

The middle area 50 of the membrane 20 is advantageously given a particularly low construction, which leads to an advantageously small constructional height of the electroacoustic transducer 1 of which the membrane 20 forms part. The middle area 50 comprises an annular connecting region 51 with elevations, which connecting region 51 serves for fastening to the vibration coil 17. Furthermore, the middle area 50 has a central cup-shaped depression 52 in the region of the membrane axis 5, which depression 52 is of cylindrical shape in this case and has a circular cup bottom wall 52*a* and a hollow cylindrical cup side wall 52*b*. The depression 52 is open towards the first membrane side 20*a*. FIG. 4 shows the middle area 50 with the central cup-shaped depression 52 in detail. It can be noted that the depression 52 may alternatively have a cuboid or some other shape, for example a prismatic shape. The depression 52 has a connecting channel 53, which connecting channel 53 leads into the cup bottom wall 52*a* and is open towards the second membrane side 20*b*, and is bounded by two planar channel side walls 53*a* and 53*b* and a planar channel bottom wall 53*c*.

Four long stiffening grooves 54 and two further long stiffening grooves 55 and 56 are present in the middle area 50, which long stiffening grooves 54, 55, 56 form a first group of stiffening grooves which are open towards the second membrane side 20*b* and extend from an edge of the pleated region 22 up to the depression 52. The long stiffening grooves 54, 55, 56 are regularly arranged in a circumferential direction of the middle region 50 at mutual angles of 60° each time, so that the long stiffening grooves 55 and 56 are diametrically opposed, and the interposed connecting channel 53 of the depression 52 issues into the two long stiffening grooves 55 and 56 and accordingly interconnects these two long stiffening grooves 55 and 56. Furthermore, six short stiffening grooves 57 are present, which short stiffening grooves 57 form a second group of stiffening grooves. The short stiffening grooves 57 are arranged in the circumferential direction at angles of 30° to the long stiffening grooves 54, 55, 56 each time and also extend from the edge of the pleated region 52 in the direction of the depression 52, but they terminate before reaching this depression 52 each with a semi-circular end portion. The fact that the short stiffening grooves 57 do not extend fully to the depression 52 but only the stiffening grooves 54, 55, 56 extend up to the depression 52 achieves that an advantageous stiffening of the middle area 50 is given and the depression 52 can be of comparatively small dimensions.

This has a particularly favorable influence on the generation and emission of medium to high frequencies in the audible range by the transducer 1, which is capable of generating and projecting frequencies of up to approximately 10 kHz, without a disadvantageous decoupling of the middle area 50 taking place.

Figure 2:
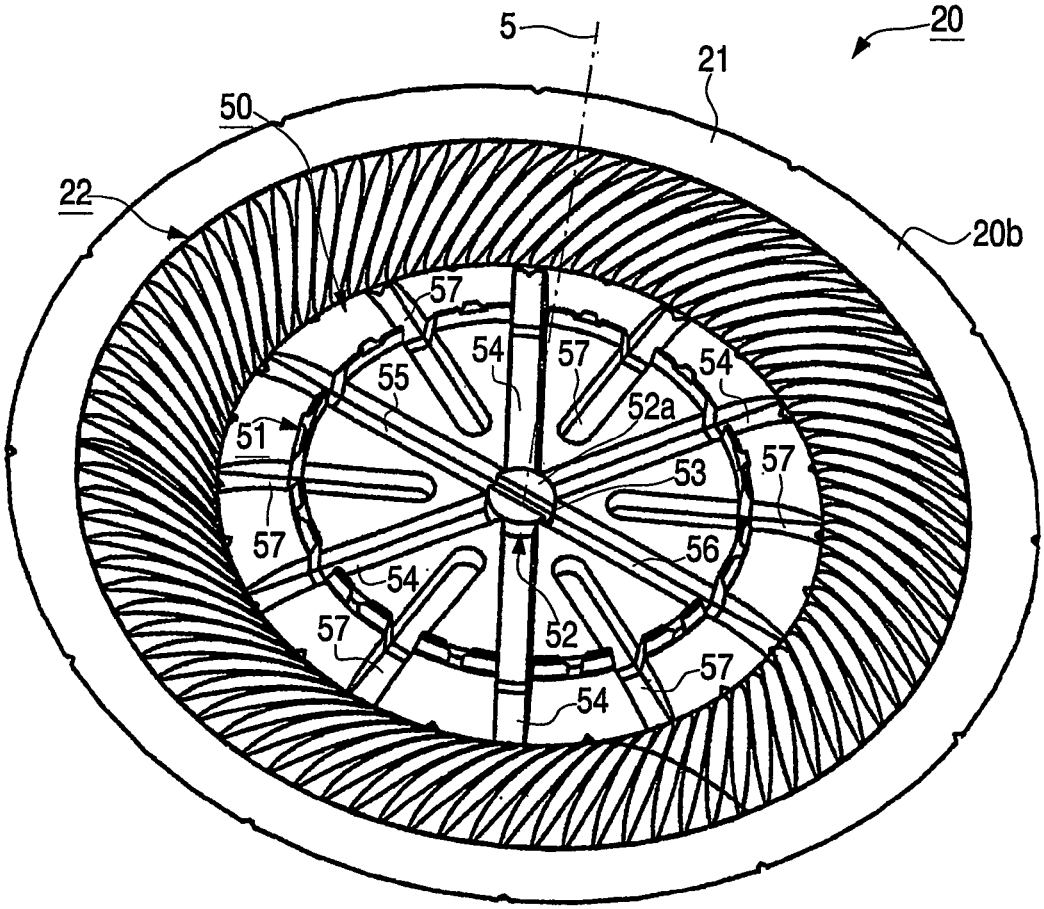
FIG. 2 is an oblique view from below of the membrane of the transducer of FIG. 1.
Figure 3:
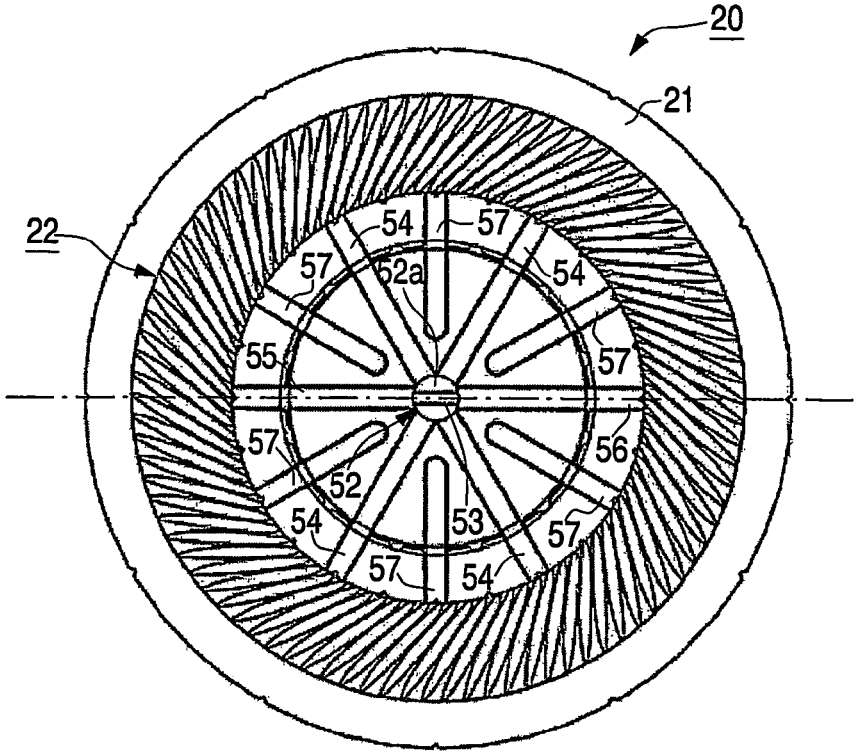
FIG. 3 is a bottom view of the membrane of FIG. 2.
Figure 4:
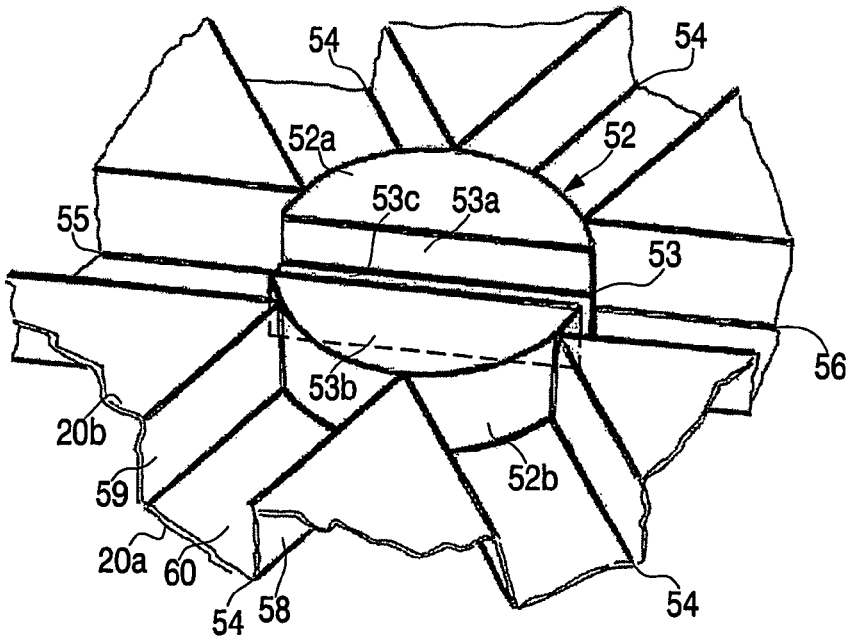
FIG. 4 is an oblique view from below of the central portion of the middle area of the membrane of FIGS. 2 and 3.

As is apparent from FIGS. 2 to 4, all stiffening grooves 54, 55, 56, 57 extend linearly, and all stiffening grooves 54, 55, 56, 57 have a substantially U-shaped cross-section, so that they are each bounded by two planar, mutually substantially parallel groove side walls 58 and 59 and a planar groove bottom wall 60. Owing to the manufacture of the membrane 20 in a deep-drawing process, the groove side walls 58 and 59 enclose an angle of at most 5° with one another because of a necessary ejection draft. The connecting channel 53 has a U-shaped cross-section which is smaller than the U-shaped cross-section of the long stiffening grooves 55 and 56, half the latter dimension in this case. It should be noted that the cross-section of the connecting channel 53 may be smaller by a different factor, for example one third or one fourth. It may further be noted that the connecting channel 53 may have the same cross-section as the long stiffening grooves 55 and 56, so that its walls lie flush with the walls of the long stiffening grooves 55 and 56. In these embodiments, however, a somewhat lesser stiffening of the middle area 50 or the area of the central cup-shaped depression 52 should be taken into account. A construction without a connecting channel in the depression 52 is also possible, but then a lesser stiffening in the region of the depression 52 should be accepted.

It is to be noted that all stiffening grooves may extend parallel to radial directions, in which case they are laterally displaced with respect to the stiffening grooves 54, 55, 56, 57 disclosed above.

It is further to be noted that a different number of stiffening grooves may be provided, for example double the number or only half the number of stiffening grooves, which stiffening grooves may again be regularly distributed or may be irregularly distributed in circumferential direction.

It is further to be noted that the depression 52 may be open towards the second membrane side 20*b*, and all stiffening grooves 54, 55, 56, 57 may be open towards the first membrane side 20*a*.

It is further to be noted that the depression 52 may comprise two mutually crossing connecting channels 53, which connecting channels 53 may have the same shape or different shapes.

It is further to be noted that the connecting channel 53 may in addition have a stiffening groove in the channel bottom wall 54*c*.

Finally, it is to be noted that a spacer 19 of a foam material is connected to the cup bottom 13 of the transducer, which spacer bears on an appliance part for damping purposes when the transducer 1 is incorporated in an appliance (mobile telephone).

The invention claimed is:

1. A membrane for an electroacoustic transducer, which membrane is designed to be capable of vibration with respect to a membrane axis, and which has a first membrane side and a second membrane side, and which has a middle area, wherein a central cup-shaped depression is present in the region of the membrane axis, which depression is bounded by a cup bottom wall and is open towards the first membrane side, wherein the membrane has stiffening grooves in its middle area which stiffening grooves extend substantially parallel to radial directions, and wherein at least two stiffening grooves of said stiffening grooves extend up to the depression.

2. A membrane as claimed in claim 1, wherein all stiffening grooves are open towards the second membrane side.

3. A membrane as claimed in claim 1, wherein the depression has a connecting channel, which connecting channel is open towards the second membrane side and leads into the two stiffening grooves that extend up to the depression.

4. A membrane as claimed in claim 1, wherein the stiffening grooves are angularly regularly spaced in circumferential direction.

5. A membrane as claimed in claim 1, wherein the stiffening grooves are arranged in at least two groups of stiffening grooves, such that the stiffening grooves of a first group extend up to the depression, and the stiffening grooves of a second group terminate before reaching the depression.

6. A membrane as claimed in claim 1, wherein the stiffening grooves extend with their ends facing away from the depression up to an annular intermediate portion of the membrane.

7. A membrane as claimed in claim 1, wherein the stiffening grooves extend linearly.

8. A membrane as claimed in claim 1, wherein the stiffening grooves each have groove side walls which are substantially parallel to one another.

9. A membrane as claimed in claim 1, wherein the stiffening grooves have a substantially U-shaped cross-section.

10. A membrane as claimed in claim 1, wherein the connecting channel has a cross-section smaller; than the cross-section of the stiffening grooves.

11. An electroacoustic transducer having a membrane, wherein the transducer is provided with a membrane as claimed in claim 1.

* * * * *